US008999070B2

(12) United States Patent
MacKenzie

(10) Patent No.: US 8,999,070 B2
(45) Date of Patent: Apr. 7, 2015

(54) BLOCKAGE REMOVAL APPARATUS AND METHOD

(75) Inventor: Hugh MacKenzie, Aberdeen (GB)

(73) Assignee: Paradigm Flow Services Services Limited, Aberdeen (GB)

( * ) Notice: Subject to any disclaimer, the term of this patent is extended or adjusted under 35 U.S.C. 154(b) by 178 days.

(21) Appl. No.: 13/498,624

(22) PCT Filed: Sep. 28, 2010

(86) PCT No.: PCT/GB2010/051623

§ 371 (c)(1),
(2), (4) Date: Apr. 11, 2012

(87) PCT Pub. No.: WO2011/036502

PCT Pub. Date: Mar. 31, 2011

(65) Prior Publication Data

US 2012/0186661 A1 Jul. 26, 2012

(30) Foreign Application Priority Data

Sep. 28, 2009 (GB) ..... 0916887.3

(51) Int. Cl.
*B08B 9/00* (2006.01)
*B08B 9/032* (2006.01)

(52) U.S. Cl.
CPC ..... *B08B 9/0321* (2013.01); *B08B 9/0326* (2013.01)

(58) Field of Classification Search
CPC ..... B08B 9/27; B08B 9/0321; B08B 9/0325; B08B 9/0326
USPC ..... 134/17, 18, 22.12, 22.18, 34, 37, 166 C, 134/166 R, 167 C, 167 R, 169 C, 168 R, 134/169 R; 137/15.05, 238, 239, 240, 563; 406/85
See application file for complete search history.

(56) References Cited

U.S. PATENT DOCUMENTS

| | | | | |
|---|---|---|---|---|
| 3,457,108 | A | 7/1969 | Hittel | |
| 4,551,041 | A | 11/1985 | Coon et al. | |
| 4,629,128 | A | 12/1986 | Lawrence | |
| 4,878,517 | A | 11/1989 | Prange | |
| 4,933,017 | A * | 6/1990 | Brzoska | 134/21 |
| 4,933,018 | A | 6/1990 | Prange | |
| 4,974,617 | A | 12/1990 | Simon | |
| 5,183,513 | A | 2/1993 | Sajewski | |
| 5,265,629 | A | 11/1993 | Sajewski | |
| 5,287,867 | A * | 2/1994 | Plummer et al. | 134/56 R |
| 5,423,917 | A | 6/1995 | Garcia, Jr. | |
| 5,615,695 | A | 4/1997 | Chambers | |
| 5,674,323 | A | 10/1997 | Garcia | |

(Continued)

FOREIGN PATENT DOCUMENTS

| | | |
|---|---|---|
| EP | 0 265 549 A1 | 5/1988 |
| EP | 0 752 282 A1 | 1/1997 |
| FR | 2 263 831 | 10/1975 |

*Primary Examiner* — Craig Schneider
(74) *Attorney, Agent, or Firm* — Saul Ewing LLP

(57) ABSTRACT

The invention provides a method and apparatus for removing a blockage from a fluid conduit. An apparatus comprises a first portion containing a fluid volume separated from the fluid conduit via a controllable valve. The valve is cyclically opened and closed such that a pressure differential between the first portion and the fluid conduit causes a series of pressure pulses in the fluid conduit. The pressure differential is regulated to control the amplitude of the pressure pulses of the series.

35 Claims, 2 Drawing Sheets

(56) References Cited

U.S. PATENT DOCUMENTS

| | | | | |
|---|---|---|---|---|
| 5,915,395 | A | 6/1999 | Smith | |
| 6,363,566 | B1 | 4/2002 | Collins | |
| 7,275,550 | B2 * | 10/2007 | Nealon | 134/22.1 |
| 7,306,001 | B1 | 12/2007 | Garcia, Jr. | |
| 7,421,757 | B1 | 9/2008 | Garcia, Jr. | |
| 2004/0261821 | A1 * | 12/2004 | Walker | 134/21 |
| 2005/0139238 | A1 * | 6/2005 | Ferrara | 134/22.11 |

* cited by examiner

BLOCKAGE REMOVAL APPARATUS AND METHOD

CROSS REFERENCE TO RELATED APPLICATIONS

This application claims the priority of PCT/GB2010/051623, filed on Sep. 28, 2010, which claims the benefit of priority to Great Britain Application No. 0916887.3, filed on Sep. 28, 2009, the entire contents of which are hereby incorporated in total by reference.

The present invention relates to an apparatus and method for cleaning of fluid conduits or vessels. The invention has particular application to the removal of blockages from fluid conduits used in the hydrocarbon exploration and production industry, for example fluid conduits contained within umbilicals. The invention also relates to a method and apparatus for generating a pulse in a fluid conduit or vessel.

BACKGROUND TO THE INVENTION

During hydrocarbon exploration and production processes, it is common for the interiors of fluid conduits, including pipelines, wellbores, risers and umbilicals to become fouled. The fouling often leads to the formation of a blockage within the fluid conduit, which may be as a result of a gradual build-up of material on the inside surface of the conduit or the formation of a plug as an unwanted by-product of a (possibly unanticipated) chemical reaction. The blockage prevents further use of the fluid conduit and must be removed before the process can continue.

A range of techniques have been developed for removing blockages from fluid conduits. These range from lance or nozzle jet systems, which are inherently limited in their range, and ultrasonic systems which apply acoustic energy to the fluid to attempt to induce cavitation in the fluid.

It has also been proposed to use pulses of pressurised fluid in order to remove material from internal surfaces of fluid conduits and vessels. U.S. Pat. No. 5,183,513 describes a system in which a high pressure pump is coupled to a fluid vessel via a pressure regulator. A controllable valve is located in the fluid line between the vessel and the pressure regulator, and is connected to the vessel via a controllable valve. The valve is cyclically opened and closed to allow pressure pulses to pass into the vessel. The operation of the valve is controlled such that the pulses are formed at frequencies, pressures and temperatures that induce cavitation within the fluid which is said to remove material from the internal surfaces of the vessel.

Cavitation is undesirable in many applications because the implosion of bubbles can pit or damage the internal surfaces of a fluid system.

Pressure pulse systems such as those described in U.S. Pat. No. 5,183,518 are deficient in controlling the magnitude of the pulses. This presents a particular difficulty when the fluid conduit or vessel is sensitive to pressure, as may be the case in many hydrocarbon production and transportation installations. There is a concern amongst operators of such installations that uncontrolled pulses which are allowed to pass into a fluid system will cause damage resulting in reduced integrity and a shortened operating lifetime.

There is therefore a need for a method and apparatus for cleaning pipeline systems which is improved with respect to the previously proposed systems.

It is amongst the aims and objects of the invention to provide a method and apparatus for cleaning of fluid conduits or vessels which allows the delivery of fluid pressure pulses with controlled pressure pulses.

Further aims and objects will become apparent from reading the following description.

SUMMARY OF THE INVENTION

According to a first aspect of the invention there is provided a method for removing a blockage from a fluid conduit, the method comprising:

providing an apparatus comprising a first portion containing a fluid volume separated from the fluid conduit via a controllable valve;

cyclically opening and closing the controllable valve such that a pressure differential between the first portion and the fluid conduit causes a series of pressure pulses in the fluid conduit;

regulating the pressure differential to control the amplitude of the pressure pulses of the series.

The method may comprise regulating the pressure of the fluid volume in the first portion so that it is greater than the pressure in the fluid conduit (referred to as a positive pressure differential); and transmitting positive pressure pulses to the conduit.

Alternatively the method may comprise regulating the pressure of the fluid volume in the first portion so that it is less than the pressure in the fluid conduit (referred to as a negative pressure differential); and transmitting negative pressure pulses to the conduit.

The method may comprise transmitting both positive and negative pressure pulses into the fluid conduit. For example, the method may comprise transmitting a series of positive pressure pulses into the system (during a pressuring up cycle) followed by a series of negative pressure pulses (during a pressure bleeding cycle) or vice versa.

In the prior art systems, allowing pressure pulses to be transmitted to a fluid conduit changes the fluid pressure in the conduit. Where positive pressure pulses are transmitted the fluid pressure in the conduit is increased with every pulse, thereby reducing the differential pressure and the magnitude of subsequent pulses. Where negative pressure pulses are transmitted, a gradual equalisation of pressure may occur (in a closed system) which reduces the magnitude of subsequent pulses. Alternatively, for a system in which the first portion is held at low pressure, the magnitude of the negative pulses transmitted may be undesirably large.

The method allows the pressure regulator to compensate for pressure changes in the system to maintain the pressure differential within an acceptable and preferred range. This allows control of the amplitude of the pressure pulses generated in the fluid conduit. The method may therefore comprise a feedback mechanism which monitors a change to the pressure conditions due to the transmission of a pulse and adjusts or regulates a pressure differential in response.

Preferably the method includes measuring (a second) fluid pressure in the fluid conduit. The method may include measuring an average pressure in the fluid conduit, for example over a period of at least one pulse cycle.

The method may include the step of measuring a first fluid pressure in the first portion. The pressure differential may then be calculated from the first and second fluid pressures. Alternatively the first fluid pressure may be determined indirectly from parameters and/or calibration of a pressure regulator used to regulate the pressure in the first portion.

Preferably the first and/or second fluid pressure measurements are communicated to a control module, which may be in the form of a programmable logic controller (PLC). Preferably the control module controllably operates the valve.

Where there is a pressure bleed cycle from the fluid conduit, the method may comprise the step of directing fluid through a second controllable valve by cyclically opening and closing the valve. The second controllable valve is preferably located on a fluid return line.

By providing a fluid return line, pressure may be bled from the conduit along a separate flow path. This facilitates the use of an advantageous class of valve as will be described below.

According to a second aspect of the invention there is provided an apparatus for removing a blockage from a fluid conduit or vessel, the apparatus comprising:

a first portion containing a fluid volume;

a connector for coupling the first portion to the fluid conduit or vessel;

a controllable valve disposed between the first portion and the connector;

at least one pressure sensor for measuring a pressure in the fluid conduit or vessel;

a control module for opening and closing the valve;

and a fluid pressure regulator configured to control the fluid pressure in the first portion in response to a signal from the pressure sensor.

Preferably the apparatus is configured to cyclically open and close the valve to transmit pressure pulses into a fluid conduit to remove a blockage. Preferably the apparatus is configured to measure a differential pressure, which may be a differential pressure across the valve.

Preferably the apparatus is arranged to be coupled to a high pressure pump. Alternatively a high pressure pump may form a part of the apparatus.

Preferably the pressure regulator comprises a pressure relief valve, which may be a proportional pressure relief valve. The pressure regulator may therefore be capable of balancing a reduction in the pressure differential across the controllable valve by bleeding pressure from the low pressure side of the controllable valve.

The pressure regulator may be a two-way pressure regulator, and more preferably is electronically controllable. The apparatus may comprise a control module for configuring operational parameters of the apparatus. The operational parameters may be one or more selected from the group consisting of: operating frequency; pulse width; maximum differential pressure (dP); maximum pressure; and minimum pressure.

The apparatus may comprise a fluid return line from the fluid conduit to the first portion. The fluid return line may comprise a second valve. Preferably the second valve is configured for controllable transmission of fluid pressure pulses, e.g. during a bleed-down cycle.

At least one of the valve and/or the second valve is preferably an oscillating valve, and more preferably is a fast-acting oscillating valve. At least one is may be electronically operable, and in one embodiment is a solenoid-actuated oscillating valve. At least one of the valves may have an orifice in the range of 10 mm to 20 mm, preferably about 15 mm. At least one of the valves may have a flow rate in the range of 300 to 500 liters per minute, preferably about 400 liters per minute.

At least one of the valve and/or the second valve may be a hydraulically actuated valve. The apparatus may comprise a hydraulic control system for the hydraulically actuated valve.

Preferred or optional embodiments of the second aspect of the invention may comprise preferred or optional features of the first aspect of the invention or vice versa.

According to a third aspect of the invention there is provided a hydrocarbon production or transportation system comprising a fluid conduit and an apparatus for removing a blockage from the fluid conduit coupled to the conduit, the system comprising a first portion containing a first fluid volume;

a controllable valve disposed between the first portion and the fluid conduit;

a pressure source for providing pressurised fluid to the first portion;

a control module configured for opening and closing the valve to allow pressure pulses into the fluid conduit;

pressure sensing means for determining a pressure differential across the controllable valve;

and a fluid pressure regulator configured to control the fluid pressure in the first portion in response to a signal from the pressure sensing means.

The system may comprise a dynamic pressure regulator, for example using a closed fluid system using a two-way regulator, or may comprise a static pressure regulator, for example using pressure relief valves.

Preferred or optional embodiments of the third aspect of the invention may comprise preferred or optional features of the first or second aspects of the invention or vice versa.

According to a fourth aspect of the invention there is provided an apparatus for removing a blockage from a fluid conduit or vessel, the apparatus comprising:

a first portion containing a fluid volume;

a connector for coupling the first portion to the fluid conduit or vessel;

a first controllable valve disposed between the first portion and the connector configured to transmit positive pressure pulses in a direction from the first portion to the connector;

a fluid return line;

a second controllable valve disposed between the first portion and the connector configured to bleed pressure pulses in a direction from the connector to the first portion; and a control module for opening and closing the first and second valves.

Preferred or optional embodiments of the fourth aspect of the invention may comprise preferred or optional features of the first to third aspects of the invention or vice versa.

The invention also extends to the cleaning of the interior surfaces of pipelines, conduits, or vessels and therefore according to further aspects of the invention there are provided a method and apparatus of cleaning the interior surface of fluid systems comprising the features of the first and second aspects of the invention.

According to a fifth aspect of the invention there is provided an apparatus for generating a pressure pulse in a fluid conduit or vessel, the apparatus comprising:

a first portion containing a fluid volume;

a connector for coupling the first portion to the fluid conduit or vessel;

a controllable valve disposed between the first portion and the connector;

at least one pressure sensor for measuring a pressure in the fluid conduit or vessel;

a control module for opening and closing the valve;

and a fluid pressure regulator configured to control the fluid pressure in the first portion in response to a signal from the pressure sensor.

Preferred or optional embodiments of the fifth aspect of the invention may comprise preferred or optional features of the first to fourth aspects of the invention or vice versa.

According to a sixth aspect of the invention there is provided an apparatus for generating a pressure pulse in a fluid conduit or vessel, the apparatus comprising:

a first portion containing a fluid volume;

a connector for coupling the first portion to the fluid conduit or vessel;

a first controllable valve disposed between the first portion and the connector configured to transmit positive pressure pulses in a direction from the first portion to the connector;

a fluid return line;

a second controllable valve disposed between the first portion and the connector configured to bleed pressure pulses in a direction from the connector to the first portion;

and a control module for opening and closing the first and second valves.

Preferred or optional embodiments of the sixth aspect of the invention may comprise preferred or optional features of the first to fifth aspects of the invention or vice versa.

BRIEF DESCRIPTION OF THE DRAWINGS

There will now be described, by way of example only, an embodiment of the invention with reference to the drawings, of which.

DETAILED DESCRIPTION

Figure 1:
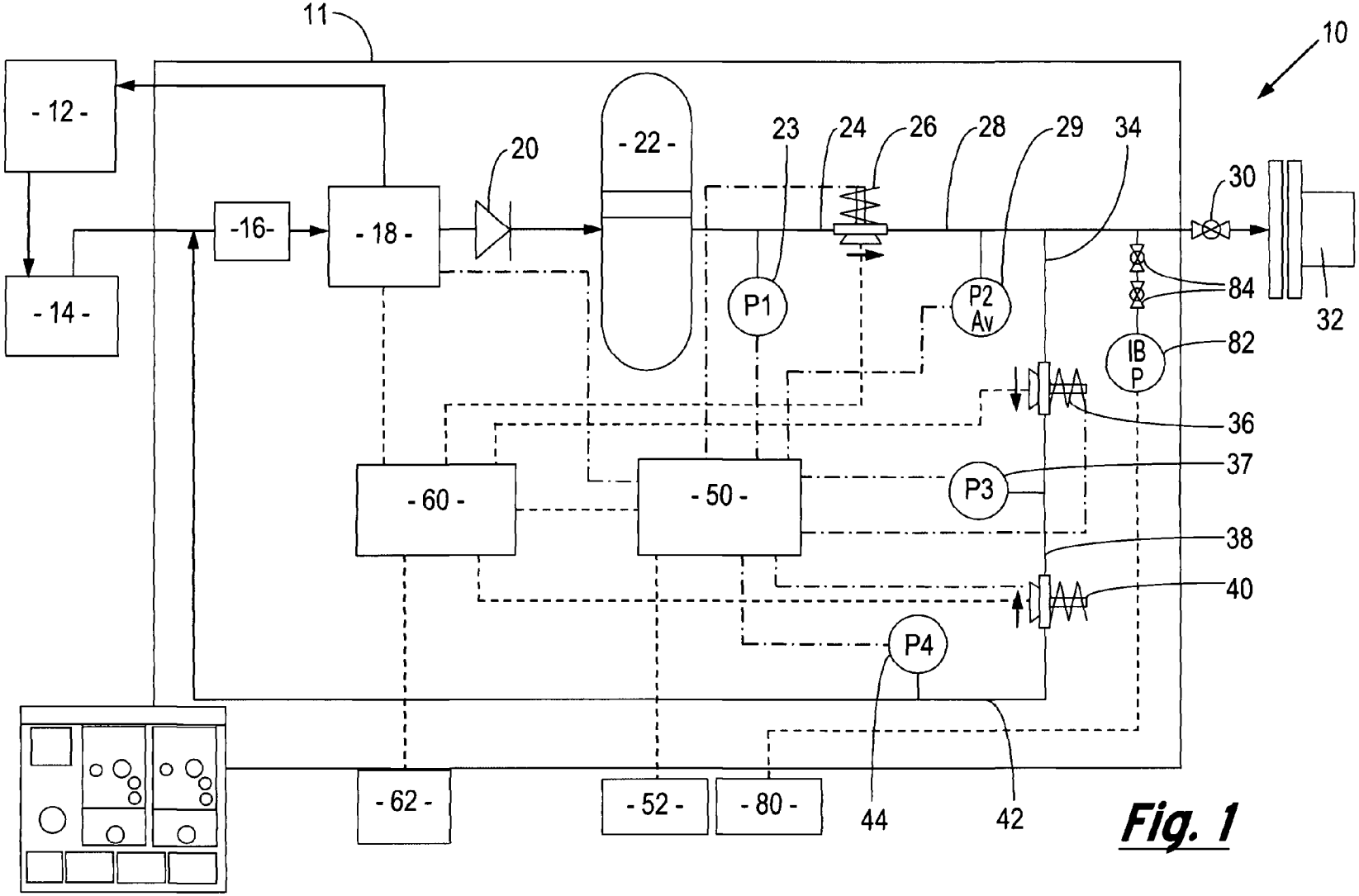
FIG. 1 is a process and instrumentation diagram of a system according to a first embodiment of invention.

Referring firstly to FIG. 1, there is shown generally depicted at 10 a fluid system comprising an apparatus 11 and a fluid conduit 32, which in this case is an umbilical. The fluid conduit 32 is coupled to the apparatus 11 via a suitable interface (not shown) and an isolation valve 30. The apparatus 11 is also connected to a fluid source 12 via a high pressure pump 14. A particulate filter 16 is located between the pump 14 and a two-way pressure regulator 18. The two-way pressure regulator 18 of this embodiment is a standard pressure regulator modified so that pressure output can be controlled by a computer or another electronic device. Suitable commercially-available examples include the Automated Pressure Regulators sold by Advanced Pressure Products of Ithaca, N.Y., United States.

A pressure accumulator 22 is connected to the pressure regulator 18 via a check valve 20. The accumulator 22 prevents loss of amplitude during the transmission of pulses as will be described below. Line 24 connects the accumulator 22 to a first oscillating valve 26, which separates a first portion of the apparatus from a line 28 in fluid communication with the conduit 32.

The oscillating valve 26 is in this embodiment a solenoid-actuated stem valve which is capable of rapid actuation and opening and closing at high frequencies (for example, up to 10 cycles per second). A suitable valve will have a valve orifice of around 15 mm and a flow of around 400 liters per minute. It has been found that this class of valve has particular benefits in many blockage removal applications due to its rapid actuation and high flow rate characteristics.

In addition, the fast actuation of the solenoid-actuated valves allows generation of well-defined, repeatable pulses which may be useful in blockage location systems which use transit time to estimate the location of a blockage. A pressure sensor 82 measures the occurrence of a pressure pulse in the conduit, and transmits the measurement data to an external module 80. Transit time between the initial pulse and the pulse reflected from the blockage in the conduit allows calculation of the distance to the blockage.

However, one limitation of some solenoid-actuated valves is that they may not rapidly open and close when exposed to pressure differentials in two directions. For example, valve 26 is only capable of rapidly opening and closing when the pressure differential is in the direction of the arrow; i.e. when the higher pressure is in the line 24. The present embodiment therefore comprises a fluid return line 34 which joins the line 28 between the valve 26 and the fluid conduit 32. Located in the fluid return line is a second oscillating valve 36, of the same type as valve 26, which separates line 38 from line 34 and the connected conduit 32. The valve 36 is arranged for fast actuation when the higher pressure is in the line 34. This arrangement allows the benefits of the invention to be exploited during both the pressure-up cycle and the pressure-bleed cycle (as described below).

Located between the oscillating valve 36 and the line 42 to the pressure regulator 18 is a controllable dump valve 40.

The apparatus 11 also includes a control unit 50 in the form of a programmable logic controller (PLC) 50. The PLC 50 communicates with the valves 26, 36 and 40, controlling their operation. The PLC 50 also controls the operation of the pressure regulator 18. An external control panel 52 allows the user operation of the PLC 50. The control panel has controls for the operating frequencies of the valve oscillators 26 and 36, the maximum differential pressure (dP), the maximum pressure and the minimum pressure. The control panel also has an on/off switch, a pressure regulator override function and visual indicators for the status of the various components of the apparatus 11.

A power distribution system 60 is provided in the apparatus 11 to receive power from an external power supply 62 and distribute power to the pressure regulator 18, the valves 26, 36 and 40, and the PLC 50.

Pressure sensor 23 measures the pressure P1 in the first portion of the apparatus between the accumulator 22 and the valve 26. Similarly, pressure sensor 29 measures the pressure P2 in the line between the valve 26 and the fluid conduit (i.e. the fluid conduit pressure), and pressure sensor 44 measures the pressure P4 in the line in the return line 42. Each pressure sensor provides a measurement signal to the PLC 50. Optionally an additional pressure sensor 37 is provided to measure the pressure in between the valve 36 and the dump valve 40 and provide a signal to the PLC 50.

Operation of the system 10 will now be described. In an initial configuration the valve oscillators 26 and 36 will normally be closed. The two-way regulator 18 is fully open. The operator enters the settings via the control panel 52, which include the operating frequencies of the valve oscillators 26 and 36, the maximum differential pressure (dP), the maximum pressure and the minimum pressure.

To begin unblocking the conduit 32, the pump 14 is activated to pump fluid from the fluid tank 12 through the apparatus 11. The oscillator valve 26 remains closed, and pressure sensor P2 takes a pressure measurement in line 28 (which is open to the conduit 32). The PLC 50 reads the pressure signal and adjusts the two way regulator 18 to increase the pressure at P1 in line 24 to a value within a pre-determined range (for example plus or minus 5%) of the preset value of P2+dP. When the value of P1 is reached, the PLC 50 commands the oscillator valve 26 to cyclically open and close at its preset frequency. Positive pressure pulses are therefore transmitted into the conduit 32 to begin to remove the blockage. Transmission of pressure pulses increases the pressure P2.

During the transmission of pulses, the two-way regulator is automatically adjusted by the PLC 50 to maintain the pressure P1 in the line 24 within the required range of P2+dP. If P1 falls outside of a predetermined range (for example by 10%)

of P2+dP during this operation then valve oscillator 26 is automatically closed. When the pressure P1 comes back within the required range of P2+dP the oscillator valve 26 recommences cycling.

When the pressure P2 in the fluid conduit reaches the preset maximum, the bleed-down cycle commences. Valve oscillator 26 is held in the open position so that pressure is not trapped in the accumulator 22 and the whole system 10 can be bled down. Valve oscillator 36 is closed, dump valve 40 is opened, and pressure P4 in line 42 is built up by the pressure regulator 18 Optional pressure sensor 37 may read the pressure P3 throughout the pressure build up operation to ensure there has been no bypass.

When pressure P4 in line 42 is adjusted by the pressure regulator 18 to a value within a preset range (for example 10% below the set value) of P2−dP, the valve oscillator 36 is activated to allow pressure to be bled from the fluid conduit 32 in a controlled manner. Negative pressure pulses are therefore transmitted into the conduit 32, which increases the pressure P4 and decreases the pressure P2. During the transmission of pulses, the two-way regulator 18 is automatically adjusted by the PLC 50 to maintain the pressure P4 in line 42 within the required range of P2−dP.

If P4 falls outside of a predetermined range (for example 10% below the set value) of P2−dP during this operation then valve oscillator 26 is automatically closed. When the pressure P1 comes back within the required range of P2+dP the oscillator valve 36 recommences cycling.

When the minimum pressure is reached in the fluid conduit 32, the oscillator valves 26, 36 and the dump valve 40 are closed. The two-way regulator 18 increases pressure P1 until it is in within the required range of P2+dP and the process is repeated.

The described embodiment allows the generation of pressure pulses of known amplitude throughout the pressure-up and bleed-down cycles, in contrast to the prior art proposals which do not adequately address the issues of compensating for pressure changes which result from the transmission of pulses. Providing amplitude control allows the parameters of the system to be set closer to the acceptable limits of the fluid conduit, with a higher level of confidence that the conduit 32 will not be damaged. Ultimately this provides a greater range of operating parameters than those available in the prior art.

The use of solenoid-actuated valves provides the advantages of quick actuation and automated operation. This facilitates operation at high frequencies without reliance on human operators to manually open and close the valves. The choice of valves has the additional benefit of producing well-defined, repeatable pulses which may be detected in or near the fluid conduit to locate the blockage.

Figure 2:
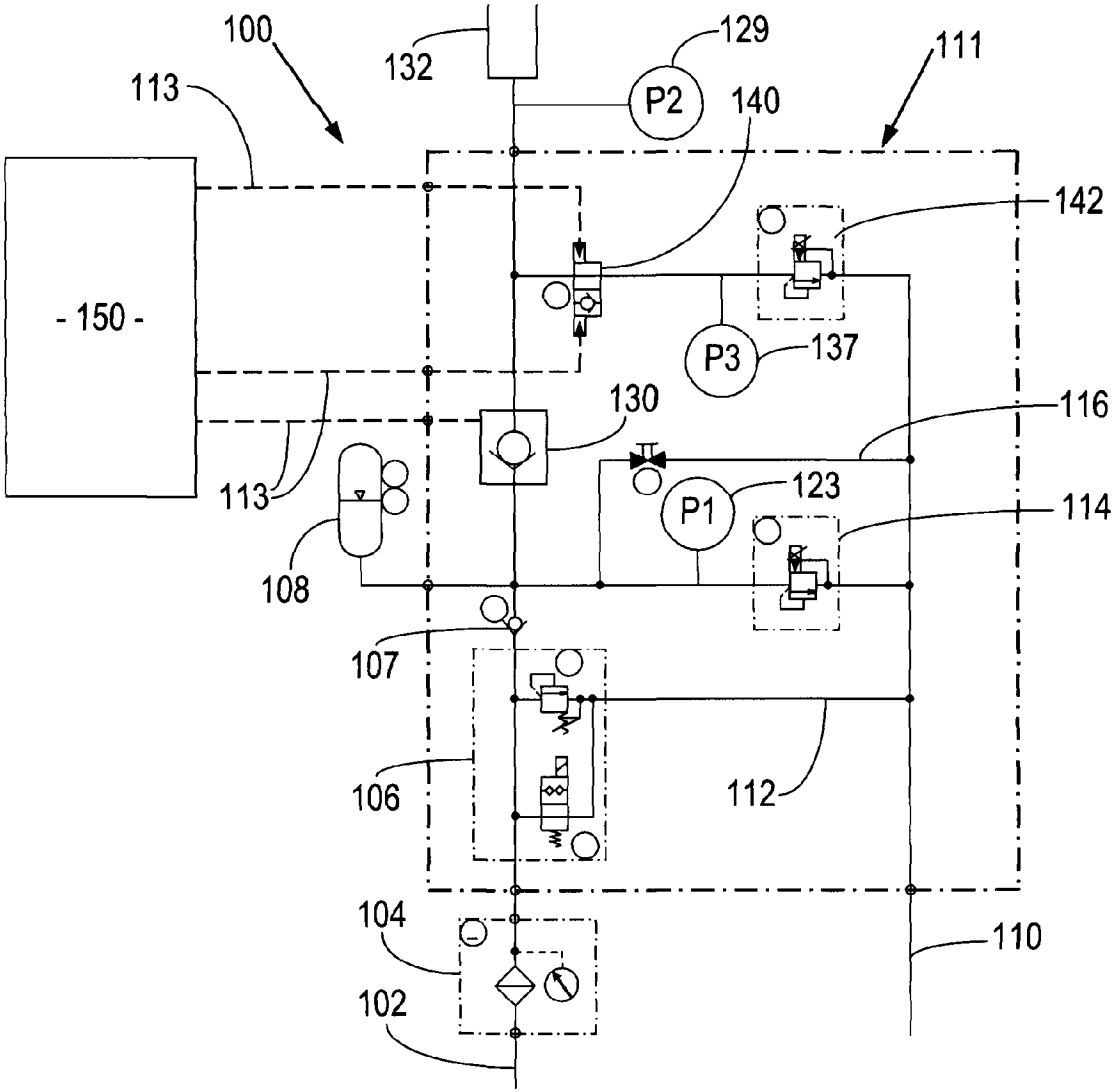
FIG. 2 is a process and instrumentation diagram of a system according to a first embodiment of invention.

In certain applications, it may be desirable to use an alternative system configuration with different valve, actuation, and/or pressure regulation components. FIG. 2 is an example of a system which is particularly suited for use with larger bore pipeline systems (for example inner diameters in the range of around 4 to 10 inches (about 100 to 250 mm)), and represents a preferred embodiment of the invention. The system, generally shown at 100, is similar to the system 10 and will be understood from FIG. 1 and the accompanying text. However, the system 100 differs in its configuration and selection of valve and pressure regulation components as will be described below.

The system 100 comprises an apparatus 111 coupled to a fluid conduit 132 via a suitable interface (not shown) and an isolation valve (not shown). A control system 150 in the form of a programmable logic controller (PLC) communicates with the apparatus 111 to set the parameters of operation and to control actuation of the valves of the apparatus. An external control panel (not shown) provides a user interface for the control system 150, and has controls for operating the frequencies of the valve oscillations, the maximum pressure differential in the system, as well as the maximum pressure and the minimum pressure in the system. The control panel also have an on/off switch, a pressure regulator override function, and visual indicators for the status of the various components of the system 100.

A fluid inlet 102 is connected to a fluid source (such as a tank) via a high pressure pump (not shown) and delivers fluid into the apparatus 111 via a particulate filter 104. An inlet pressure regulator 106 controls the pressure fluid delivered to the accumulator 108 via check valve 107, with excess fluid (over a predetermined pressure) diverted to a return line 110 via conduit 112. Therefore the inlet pressure regulator 106 delivers fluid to the accumulator 108 at a predetermined rate, set via the control system 150.

The pressure accumulator 108 prevents loss of amplitude during the transmission of pulses, as is described in relation to the embodiment of FIG. 1. Pressure within the accumulator is controlled by a pressure relief valve 114 disposed between the accumulator 108 and the return line 110. The pressure relief valve is an oil hydraulically operated proportional pressure relief valve, designed to be capable of operating at a pressure of 500 bar (50 MPa), and a flow area diameter of up to 40 millimeters. An example of a suitable valve is the DN40 PN500 pressure relief valve available from HL Hydraulik GmbH.

The apparatus 111 is also provided with an emergency pressure relief line 116 which bypasses the pressure relief valve 114 and includes an emergency stop actuation which bleeds all pressure in the accumulator to the return line 110.

The apparatus 111 comprises a first oscillating valve 120 which is hydraulically actuated from the control system 150. The oscillating valve 130 is a pilot operated check valve designed to be capable of operating at a pressure of 500 bar (50 MPa) and a flow rate of 500 liters per minute. An example of a suitable valve is the pilot operated check valve DN40 PN500 available from HL Hydraulik GmbH. Actuation of the valve 130 allows a controlled pulse or series of pulses to be input into fluid conduit 132 in a similar manner to the system 10 of FIG. 1.

The apparatus also includes a second oscillating valve 140 which is actuated by the control system 150. The valve 140 is a two-way hydraulic directional valve which can be piloted to open or close from an external oil hydraulic line. An example of a suitable valve is the two-way hydraulic directional valve DN40 PN500 available from HL Hydraulik GmbH. In the pressure up cycle, the valve 140 is preferably in an open position, but it functions to operate cyclically in a pressure bleed cycle of the apparatus (analogous to the valves 26 and 36 of the system 10). The valve 140 is disposed between the fluid conduit 132 and the return line 110, to allow return flow of fluid to the line 110 via a controllable pressure relief valve 142.

Pressure sensor 123 measures the pressure P1 in the apparatus between the accumulator 106 and the valve 130 and provides a signal to the control system 150. Similarly, pressure sensor 129 measures the pressure P2 in the line between the valve 130 and the fluid conduit 132 (i.e. the fluid conduit pressure), and pressure sensor 137 measures the pressure P3 between the valve 140 and the pressure relief valve 142, both providing signals to the control system 150.

The control system 150 actuates the valves 130, 140, 114, 142 via oil filled hydraulic lines 113 (only some of which are shown for clarity). In this embodiment, the pilot medium in the lines 113 has an operating pressure sufficiently high to allow rapid actuation of the valves. In particular, preferred embodiments of the invention are configured to operate the oscillating valves 130, 140 at pulse frequencies of greater than 1 Hz. To facilitate this, the pilot medium pressure in lines 113 is greater than 20 MPa (and typically around 30 MPa) in this embodiment of the invention. With the valve components selected, pulse frequencies of 1 to 10 Hz are contemplated by the invention.

Operation of the system 100 is similar to operation of the system 10. In an initial configuration the valve oscillator 130 will normally be closed, and valve 140 will be in its open position. The operator enters the settings in the control system 150, which include the operating frequencies of the valve oscillators 130 and 140, the maximum differential pressure (dP), the maximum pressure and the minimum pressure. It should be noted that the maximum pressure in the line can be controlled by the pressure relief valve 142, which is exposed to fluid conduit 132. To begin unblocking the conduit 132, the pump (not shown) is activated to pump fluid from a fluid tank through the inlet regulator 106 and the check valve 107 of the accumulator 108. The oscillator valve 130 remains closed, and pressure sensor P2 takes a pressure measurement in the conduit 132). The control system 150 reads the pressure signal and adjusts the pressure relief valve 114 to control the pressure at P1 to a value within a pre-determined range (for example plus or minus 5%) of a preset value of P2+dP. When the desired value of P1 is reached, the control system 150 commands the oscillator valve 130 to cyclically open and close at its preset frequency (for example 3 Hz). Positive pressure pulses are therefore transmitted into the conduit 132 to begin to remove the blockage. Transmission of pressure pulses increases the pressure P2, and therefore during the transmission of pulses, the valve 114 is automatically adjusted by the control system 150 to maintain the pressure P1 within the required range of P2+dP.

When the pressure P2 in the fluid conduit reaches a preset maximum, the bleed-down cycle commences. Valve 130 is closed and optionally pressure is bled from the accumulator to return line 110. Pressure at P3 is initially equalised to the pressure P2 in the fluid conduit, before the valve 140 is closed. The pressure relief valve 142 bleeds pressure from P3 until the differential pressure across valve 140 (i.e. P2−P3) is at the desired level. The valve 140 can then be actuated to open and close at its desired frequency (for example 3 Hz), which generates negative pressure pulses in the fluid conduit 132 as pressure is bled from the conduit 132. This has the effect of increasing the pressure P3 and decreasing the pressure P2. During the transmission of pulses, the pressure relief valve 142 is automatically adjusted by the control system 150 to maintain the pressure P3 within the required range of P2−dP. When the minimum pressure is reached in the fluid conduit 132, the process can be repeated.

The use of proportional pressure relief valves to control the pressure regulation advantageously allows a mode of operation in which the pressure differential is regulated during a pulse series. For example, the increase in pressure P3 during a pressure down cycle may be balanced by the proportional pressure relief valve, which is open sufficiently to bleed pressure to maintain the pressure differential within a desired range. Alternatively, the pressure relief valve can be operated after one pulses or a series of pulses to reset the pressure differential before the next pulse or pulses are generated.

The system 100 provides similar advantages as the system 10, principally by allowing the generation of pressure pulses of known amplitude throughout the pressure-up and bleed-down cycles. Providing amplitude control allows the parameters of the system to be set closer to the acceptable limits of the fluid conduit, with a higher level of confidence that the conduit 132 will not be damaged. The valve components and pressure regulation components of are particularly suited to conduits with inner diameters of around 2 to 12 inches (about 50 to 300 mm) and find particular commercial application in conduits of 2 to 12 inches (about 100 to 250 mm). The use of hydraulically-actuated valves with pilot medium pressures of greater than 20 MPa (and preferably around 30 Mpa) provides the advantages of quick actuation and automated operation. This facilitates operation at high frequencies without reliance on human operators to manually open and close the valves. The choice of valves has the additional benefit of producing well-defined, repeatable pulses which may be detected in or near the fluid conduit to locate the blockage using known transit time techniques.

The invention provides a method and apparatus for removing a blockage from a fluid conduit. An apparatus comprises a first portion containing a fluid volume separated from the fluid conduit via a controllable valve. The valve is cyclically opened and closed such that a pressure differential between the first portion and the fluid conduit causes a series of pressure pulses in the fluid conduit. The pressure differential is regulated to control the amplitude of the pressure pulses of the series.

Variations to the described embodiments may be made within the scope of the invention. In particular, it will be appreciated that components of the systems 10 and 100 may be interchanged with one another in alternative embodiments of the invention, and that combinations of features other than those expressly claimed are within the scope of the invention.

The invention claimed is:

1. A method of removing a blockage from a fluid conduit in a hydrocarbon production or transportation system, the method comprising:

providing an apparatus comprising a first portion containing a fluid volume separated from the fluid conduit via a controllable valve;

pressurizing the first portion of the apparatus to a first fluid pressure;

cyclically opening and closing the controllable valve such that a pressure differential between the first portion and the fluid conduit causes a series of pressure pulses in the fluid conduit;

monitoring a change in pressure conditions in the fluid conduit;

compensating for a measured change in pressure conditions in the fluid conduit by adjusting a fluid pressure in the first portion, to thereby regulate the pressure differential and control the amplitude of the pressure pulses of the series.

2. The method as claimed in claim 1 comprising maintaining the pressure differential within preferred predetermined range.

3. The method as claimed in claim 1 comprising measuring an average pressure in the fluid conduit over a period of at least one pulse cycle.

4. The method as claimed in claim 1 comprising controllably operating the valve by a control module.

5. The method as claimed in claim 1 comprising regulating the pressure of the fluid volume in the first portion so that it is greater than the pressure in the fluid conduit; and transmitting positive pressure pulses to the fluid conduit.

6. The method as claimed in claim 5 comprising transmitting a series of positive pressure pulses into the fluid conduit to increase pressure between the apparatus and the blockage during a pressuring up cycle.

7. The method as claimed in claim 1 comprising calculating the pressure differential from the first fluid pressure and a second fluid pressure measured in the fluid conduit.

8. The method as claimed in claim 7 wherein the measurements of the first fluid pressure and the measurement of the second fluid pressure in the fluid conduit are communicated to a control module.

9. The method as claimed in claim 1 comprising directing fluid through a second controllable valve by cyclically opening and closing the second controllable valve.

10. The method as claimed in claim 9 wherein the second controllable valve is located on a fluid return line.

11. The method as claimed in claim 1 comprising regulating the pressure of the fluid volume in the first portion so that it is less than the pressure in the fluid conduit; and transmitting negative pressure pulses to the conduit.

12. The method as claimed in claim 11 comprising transmitting a series of negative pressure pulses to reduce pressure between the apparatus and the blockage during a pressure bleeding cycle.

13. The method as claimed in claim 11 comprising transmitting a series of positive pressure pulses into the fluid conduit during a pressuring up cycle and transmitting a series of negative pressure pulses during a pressure bleeding cycle.

14. The method as claimed in claim 13 comprising transmitting a series of positive pressure pulses into the fluid conduit to increase pressure between the apparatus and the blockage during the pressuring up cycle, and transmitting a series of negative pressure pulses to reduce pressure between the apparatus and the blockage during the pressure bleeding cycle.

15. A method of removing a blockage from a fluid conduit in a hydrocarbon production or transportation system, the method comprising:

providing an apparatus comprising a first portion containing a fluid volume separated from the fluid conduit via a controllable valve;

pressurizing the first portion of the apparatus to a first fluid pressure;

cyclically opening and closing the controllable valve such that a pressure differential between the first portion and the fluid conduit causes a series of pressure pulses to be transmitted into the fluid conduit to the blockage, thereby causing a pressure change in the fluid conduit between the apparatus and the blockage;

subsequent to the transmission of at least one pressure pulse into the fluid conduit, measuring a fluid pressure in the fluid conduit; and adjusting a fluid pressure in the first portion of the apparatus in response to a measured change in pressure conditions in the fluid conduit to maintain the pressure differential across the controllable valve within a preferred range and maintain a desired amplitude of the pressure pulses of the series.

16. Apparatus for removing a blockage from a fluid conduit in a hydrocarbon production or transportation system, the apparatus comprising:

a first portion containing a fluid volume; a connector for coupling the first portion to the fluid conduit;

a controllable valve disposed between the first portion and the connector;

at least one pressure sensor for measuring a fluid pressure in the fluid conduit;

a control module for opening and closing the valve; and a fluid pressure regulator configured to control the fluid pressure in the first portion in response to a signal from the pressure sensor;

wherein the apparatus is configured to monitor a change in pressure conditions in the fluid conduit, and is further configured to compensate for a measured change in pressure conditions in the fluid conduit by adjusting a fluid pressure in the first portion of the apparatus.

17. The apparatus as claimed in claim 16 configured to cyclically open and close the controllable valve to transmit pressure pulses into the fluid conduit to remove a blockage.

18. The apparatus as claimed in claim 16 configured to measure a differential pressure across the controllable valve.

19. The apparatus as claimed in claim 16, wherein the pressure regulator comprises a pressure relief valve.

20. The apparatus as claimed in claim 16, wherein the pressure regulator comprises a two-way pressure regulator.

21. The apparatus as claimed in claim 16, wherein the pressure regulator is electronically controllable.

22. The apparatus as claimed in claim 16, comprising a control module for configuring operational parameters of the apparatus selected from the group consisting of: operating frequency; pulse width; maximum differential pressure (dP); maximum pressure; and minimum pressure.

23. The apparatus as claimed in claim 16, comprising a fluid return line from the fluid conduit.

24. The apparatus as claimed in claim 23, comprising a second valve disposed between the fluid conduit and the fluid return line.

25. The apparatus as claimed in claim 24, wherein the second valve is configured for controllable transmission of fluid pressure pulses.

26. The apparatus as claimed in claim 24, comprising means for regulating a pressure differential across the second valve.

27. The apparatus as claimed in claim 24, wherein at least one of the controllable valve and/or the second valve is an oscillating valve.

28. The apparatus as claimed in claim 27, wherein least one of the controllable valve and/or the second valve is electronically operable.

29. The apparatus as claimed in claim 27, wherein at least one of the controllable valve and/or the second valve is hydraulically operable.

30. The apparatus as claimed in claim 29, wherein the hydraulically operable valve is actuable by a hydraulic line at a pressure in excess of 20 Mpa.

31. A hydrocarbon production or transportation system comprising a fluid conduit and an apparatus for removing a blockage from the fluid conduit coupled to the fluid conduit, the system comprising a first portion containing a first fluid volume;

a controllable valve disposed between the first portion and the fluid conduit;

a pressure source for providing pressurised fluid to the first portion;

a control module configured for opening and closing the valve to allow pressure pulses into the fluid conduit;

pressure sensing means for determining a pressure differential across the controllable valve; and a fluid pressure regulator configured to control the fluid pressure in the first portion in response to a signal from the pressure sensing means;

wherein the system is configured to monitor a change in pressure differential across the controllable valve, and is further configured to compensate for a measured change in pressure differential across the controllable valve by adjusting a fluid pressure in the first portion of the apparatus.

32. The system according to claim 31, wherein the fluid conduit has an inner diameter in the range of approximately 50 mm to 300 mm.

33. The system according to claim 31, wherein the apparatus is an apparatus according to claim 13.

34. Apparatus for removing a blockage from a fluid conduit in a hydrocarbon production or transportation system, the apparatus comprising:

a first portion containing a fluid volume;

a connector for coupling the first portion to the fluid conduit;

a controllable valve disposed between the first portion and the connector;

at least one pressure sensor for measuring a fluid pressure in the fluid conduit;

a control module for opening and closing the valve; and a fluid pressure regulator configured to control a fluid pressure in the first portion in response to a signal from the pressure sensor;

wherein the apparatus is configured to cyclically open and close the controllable valve such that a pressure differential between the first portion and the fluid conduit causes a series of pressure pulses to be transmitted into a fluid conduit to a blockage, thereby causing a pressure change in the fluid conduit between the apparatus and the blockage; and wherein the apparatus is further configured to maintain the pressure differential across the controllable valve within a preferred range by adjusting a fluid pressure in the first portion of the apparatus in response to a measurement of the pressure change in the fluid conduit.

35. A hydrocarbon production or transportation system comprising a fluid conduit and an apparatus for removing a blockage from the fluid conduit coupled to the fluid conduit, the system comprising:

a first portion containing a first fluid volume;

a controllable valve disposed between the first portion and the fluid conduit;

a pressure source for providing pressurised fluid to the first portion;

a control module configured for opening and closing the valve to allow pressure pulses into the fluid conduit;

pressure sensing means for determining a pressure differential across the controllable valve; and a fluid pressure regulator configured to control a fluid pressure in the first portion in response to a signal from the pressure sensing means;

wherein the system is configured to cyclically open and close the controllable valve such that the pressure differential between the first portion and the fluid conduit causes a series of pressure pulses to be transmitted into the fluid conduit to the blockage, thereby causing a pressure change in the fluid conduit between the controllable valve and the blockage; and wherein the system is further configured to maintain the pressure differential across the controllable valve within a preferred range by adjusting the fluid pressure in the first portion in response to a measurement of the pressure change in the fluid conduit.

* * * * *